US009839283B2

(12) United States Patent
Tatu et al.

(10) Patent No.: US 9,839,283 B2
(45) Date of Patent: Dec. 12, 2017

(54) ORAL CARE IMPLEMENT WITH PRODUCT APPLICATOR

(71) Applicant: COLGATE-PALMOLIVE COMPANY, New York, NY (US)

(72) Inventors: Francis Tatu, Manlius, NY (US); Kathryn Neal, Skaneateles, NY (US); Sharon Kennedy, Randallstown, MD (US); Brian G. Worthington, Dunellen, NJ (US); Eduardo J. Jimenez, Manalapan, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 217 days.

(21) Appl. No.: 14/650,827

(22) PCT Filed: Dec. 12, 2012

(86) PCT No.: PCT/US2012/069040

§ 371 (c)(1),
(2) Date: Jun. 9, 2015

(87) PCT Pub. No.: WO2014/092699

PCT Pub. Date: Jun. 19, 2014

(65) Prior Publication Data

US 2015/0320193 A1 Nov. 12, 2015

(51) Int. Cl.
*A46B 11/00* (2006.01)
*A46B 15/00* (2006.01)

(52) U.S. Cl.
CPC ..... *A46B 11/0086* (2013.01); *A46B 11/001* (2013.01); *A46B 11/002* (2013.01); (Continued)

(58) Field of Classification Search
CPC combination set(s) only.
See application file for complete search history.

(56) References Cited

U.S. PATENT DOCUMENTS 1,292,416 A 1/1919 Auld
1,988,557 A * 1/1935 Jecker ..... A46B 11/0027 401/174

(Continued)

FOREIGN PATENT DOCUMENTS

CN 85203726 12/1986
CN 2381191 6/2000

(Continued)

OTHER PUBLICATIONS

International Search Report and the Written Opinion of the International Searching Authority issued in International Application PCT/US2012/069040 dated Sep. 18, 2013.

(Continued)

*Primary Examiner* — David Walczak

(57) ABSTRACT

An oral care implement with product application. In one embodiment, the implement is a fluid dispensing toothbrush having a body comprised of a handle, a head, and an internal cavity containing an oral care material. The head includes tooth cleaning elements and an applicator in fluid communication with the internal cavity. In one embodiment, the applicator includes at least one spring-actuated valve operable to dispense the fluidic oral care material upon engagement with a user's oral tissue. The oral care material is delivered from the internal cavity upon applying a pressing force to a moveable sealing element of the valve. In certain embodiments, a pressurizer may be provided to pressurize the oral care material for positive dispensing. In one embodiment, the applicator is disposed in a soft tissue cleaner on the toothbrush head.

20 Claims, 8 Drawing Sheets

(52) U.S. Cl.
CPC ..... *A46B 11/0017* (2013.01); *A46B 11/0024* (2013.01); *A46B 11/0037* (2013.01); *A46B 11/0041* (2013.01); *A46B 11/0055* (2013.01); *A46B 11/0079* (2013.01); *A46B 15/0081* (2013.01); *A46B 2200/1066* (2013.01)

(56) References Cited

U.S. PATENT DOCUMENTS

| | | | | | |
|---|---|---|---|---|---|
| D134,723 | S | | 1/1943 | Riksheim | |
| 2,637,060 | A | | 5/1953 | Cowan | |
| 2,743,042 | A | | 4/1956 | Burgin | |
| 2,800,899 | A | | 7/1957 | Barron | |
| 3,256,894 | A | * | 6/1966 | Sherman | A46B 11/0055 222/209 |
| 3,296,642 | A | | 1/1967 | Aylott | |
| 4,221,494 | A | | 9/1980 | Kachur | |
| 4,296,518 | A | | 10/1981 | Furrier et al. | |
| 4,879,781 | A | | 11/1989 | Desimone | |
| 5,062,728 | A | | 11/1991 | Kuo | |
| 5,096,319 | A | | 3/1992 | Gueret | |
| D337,659 | S | | 7/1993 | Lacy | |
| 5,242,233 | A | | 9/1993 | Sirota | |
| 5,338,124 | A | * | 8/1994 | Spicer | A46B 11/0041 401/146 |
| 5,407,287 | A | * | 4/1995 | Braun | A46B 11/0017 401/176 |
| 5,611,687 | A | | 3/1997 | Wagner | |
| 5,765,573 | A | | 6/1998 | Gueret | |
| 6,179,503 | B1 | | 1/2001 | Taghavi-Khanghah | |
| 6,202,247 | B1 | | 3/2001 | Lorenz, Jr. | |
| 6,926,166 | B1 | | 8/2005 | Bitton et al. | |
| 6,939,071 | B1 | | 9/2005 | Breidenbach et al. | |
| 7,172,360 | B2 | | 2/2007 | McSweeney et al. | |
| 7,651,292 | B2 | | 1/2010 | Tavares da Silva | |
| 8,714,853 | B2 | | 5/2014 | Sutcliffe et al. | |
| 2002/0073496 | A1 | | 6/2002 | Kim | |
| 2004/0237226 | A1 | | 12/2004 | Hohlbein et al. | |
| 2004/0255416 | A1 | | 12/2004 | Hohlbein | |
| 2005/0000049 | A1 | | 1/2005 | Hohlbein | |
| 2005/0002726 | A1 | | 1/2005 | Bostal | |
| 2006/0133885 | A1 | | 6/2006 | Kaminski | |
| 2012/0301209 | A1 | | 11/2012 | Fattori | |

FOREIGN PATENT DOCUMENTS

| | | |
|---|---|---|
| CN | 1849962 | 10/2006 |
| EP | 0 290 873 | 11/1988 |
| WO | WO 01/45573 | 6/2001 |
| WO | WO 2009/157932 | 12/2009 |
| WO | WO 2012/134438 | 10/2012 |

OTHER PUBLICATIONS

Written Opinion of the International Preliminary Examining Authority issued in International Application PCT/US2012/069040 dated Feb. 19, 2015.

* cited by examiner

ORAL CARE IMPLEMENT WITH PRODUCT APPLICATOR

CROSS-REFERENCE TO RELATED PATENT APPLICATIONS

This application is a U.S. national stage application under 35 U.S.C. §371 of PCT Application No. PCT/US2012/069040, filed Dec. 12, 2012, the entirety of which is incorporated herein by reference.

BACKGROUND OF THE INVENTION

Toothbrushes are typically used by applying toothpaste or dentifrice to a bristle section on the head of the toothbrush, followed by brushing regions of the oral cavity (e.g., the teeth or soft tissue such as the tongue and/or gums) with the bristle section. Some toothbrushes have been equipped with internal reservoirs and systems for delivering auxiliary or supplemental oral care materials, such as whitening agents, breath-freshening agents and others to a user's oral cavity, in addition to dentifrice. However, in known toothbrushes having oral care material contained therein, the delivery mechanism or channels may become clogged. Such toothbrushes do not adequately deliver the oral care material to a user's oral cavity and can force a user to spend time unclogging the device. Furthermore, some delivery systems utilize either a pump to force the fluid from a reservoir through an opening in a head of the toothbrush or rely on capillary action to flow the oral care material from the reservoir to the head. A stationary applicator, such as a pad or bristles, is then used to apply the oral care material to the oral surface. Thus, a need exists for an improved system for delivering and/or applying an oral care material contained within the oral care implement to a user's oral cavity.

BRIEF SUMMARY OF THE INVENTION

Exemplary embodiments according to the present disclosure are directed to oral care implements that have an oral care material contained therein and being operable to dispense the material to a user. In one embodiment, the oral care material is dispensed through the head of the oral care implement. In one embodiment, the oral care implement is a toothbrush.

According to one embodiment, a toothbrush includes a body comprising a handle, a head coupled to the handle, and an internal cavity containing an oral care material, a plurality of tooth cleaning elements extending from the head, and an applicator disposed in the head and in fluid communication with the internal cavity. The applicator includes at least one spring-actuated valve movable from the closed non-dispensing position to an open dispensing position upon applying a pressing force against an externally exposed portion of the valve wherein oral care material is dispensed from the internal cavity.

According to another embodiment, a toothbrush includes a body defining a longitudinal axis and comprising a handle, a head coupled to the handle, and an internal cavity containing an oral care material, a plurality of tooth cleaning elements extending from the head, and an applicator disposed in the head and in fluid communication with the internal cavity. The applicator includes at least one spring-actuated valve including a depressible sealing element and a spring member biasing the sealing element into a closed non-dispensing position. The sealing element is linearly movable from the closed non-dispensing position to an open dispensing position upon applying a pressing force against the sealing element wherein oral care material is dispensed from the internal cavity through the user.

According to another embodiment, a toothbrush includes a body defining a longitudinal axis and comprising a handle, a head coupled to the handle, and an internal cavity disposed in the head containing an oral care material, a plurality of tooth cleaning elements extending from the head, and an applicator disposed in the head and in fluid communication with the internal cavity. The applicator includes a spring plate mounted in the head of the toothbrush, a plurality of spring members disposed on the spring plate, a plurality of sockets disposed in the head of the toothbrush, and a plurality of depressible sealing element engageable with the socket. Each one of the spring members, sockets, and sealing elements collectively defining a spring-actuated valve. Each of the sealing elements are linearly movable from a closed non-dispensing position to an open dispensing position upon applying a pressing force against the sealing element wherein oral care material is dispensed from the internal cavity through the user.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
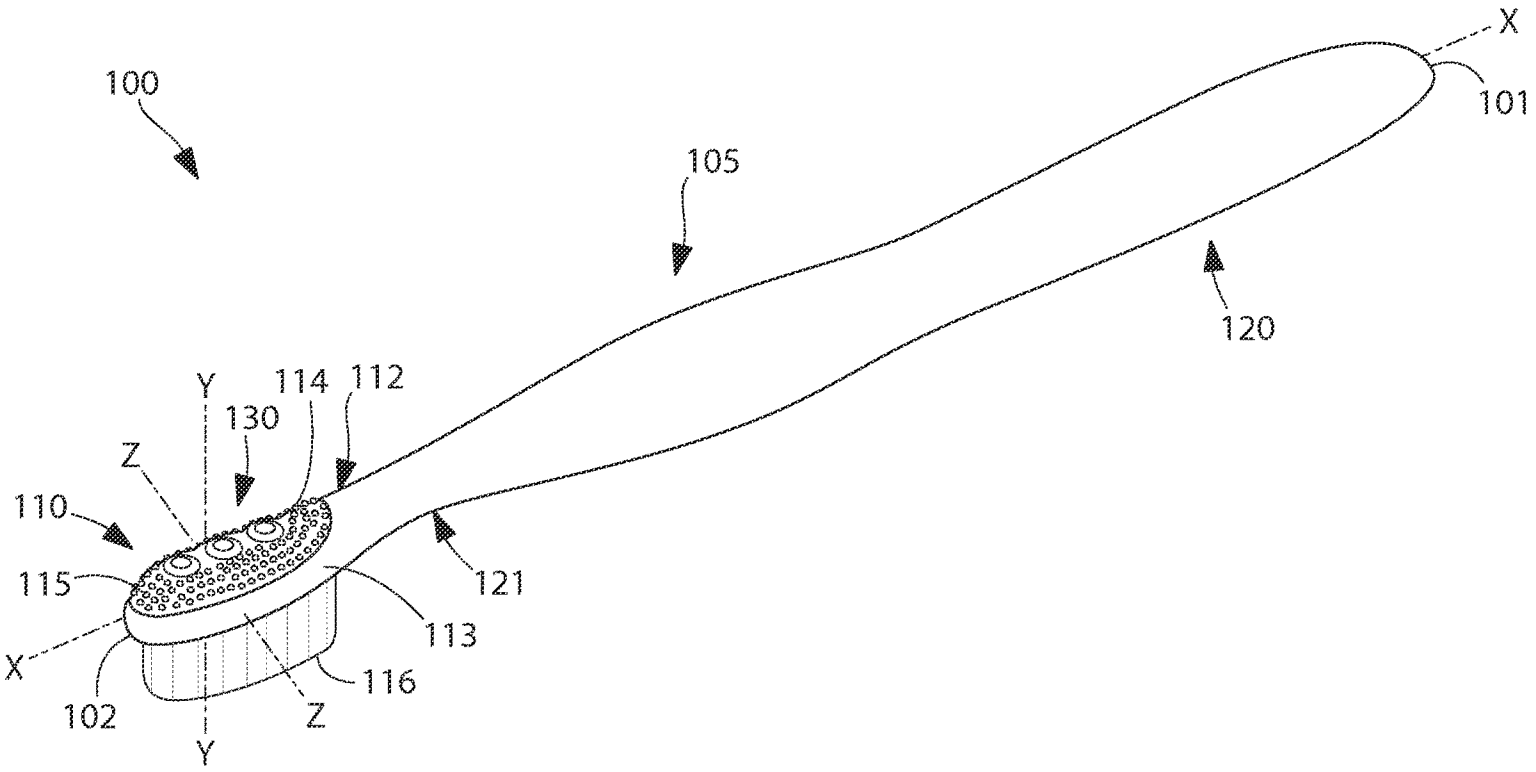
FIG. 1 is a rear perspective view of an oral care implement, in the form of a toothbrush, according to one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

Referring to FIG. 1, a toothbrush 100 in accordance with one embodiment of the present invention is illustrated. In the exemplified embodiments disclosed herein, the invention is illustrated and described in the form of a manual toothbrush. However, the invention is not so limited in all embodiments. In other embodiments, the oral care implement may take other forms, including without limitation a powered toothbrush, an interdental device, a soft tissue cleaner or any other type of ansate oral care implement as is known in the art.

Figure 2:
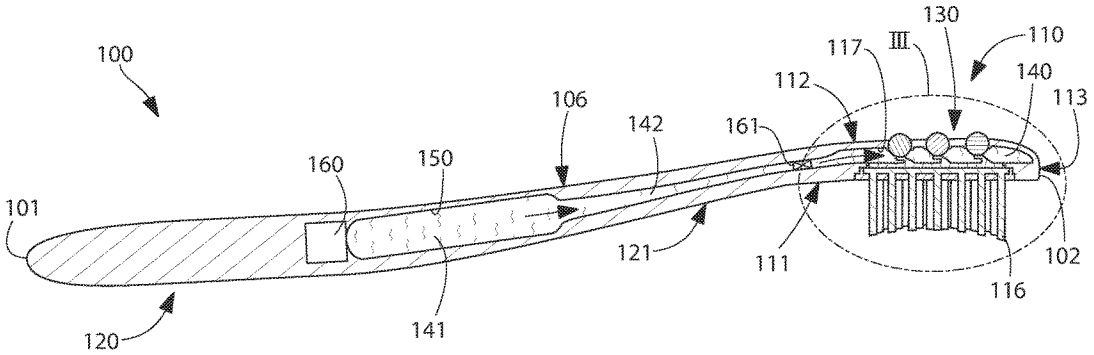
FIG. 2 is a longitudinal cross-sectional view of the head of the toothbrush of FIG. 1 taken along longitudinal axis line X-X of FIG. 1.

The toothbrush 100 extends axially from a proximal end 101 to a distal end 102 along a longitudinal axis X-X. The toothbrush 100 generally comprises a body 105 having a head 110 and a handle 120. The body 105 comprises an outer surface 106 and an inner surface 117 (FIG. 2). The body 105 is constructed of a material having suitable rigidity for handling of the toothbrush 100 and being sufficiently impervious to fluids so that an oral care material, such as a fluid, can be stored within an internal cavity 140 and/or a reservoir 150 contained within the body 105 of the toothbrush 100 (discussed below). Suitable materials for the body 105 include hard plastics, such as polyethylene, polypropylene (PP), polyamide, polyester, cellulosics, SAN, acrylic, ABS or any other of the commonly known thermoplastics used in toothbrush manufacture.

Toothbrush 100 defines an X, Y and Z axis in a Cartesian coordinate system shown in FIG. 1, which used for reference herein in describing embodiments according to the present disclosure. Both the Y-Y and Z-Z axes are transverse axes with respect to the longitudinal axis X-X.

The head 110 is coupled to a distal end of the handle 120 via the neck 121. In the exemplary embodiment, the head 110 and the handle 120 are integrally formed as a single unitary structure using a molding, milling, machining or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 110 and the handle 120 are of a unitary or multi-piece construction (including connection techniques) is not limiting of the present invention, unless specifically claimed. In some embodiments of the invention, the head 110 may be detachable (and replaceable) from the handle 120 using techniques known in the art.

Referring to FIGS. 1 and 2, the head 110 comprises a front surface 111, an opposing rear surface 112 and a peripheral side surface 113 extending around the perimeter of the head. The front surface 111 and the rear surface 112 of the head 110 can take on a wide variety of shapes and contours, none of which are limiting of the present invention. For example, the front and rear surfaces 111, 112 can be planar, contoured or combinations thereof. While the head 110 is normally widened laterally relative to the neck of the handle 120 in a direction of a transverse axis Y-Y, it could in some constructions simply be a continuous extension or narrowing of the handle 120.

Moreover, in certain embodiments with reference to FIGS. 1 and 4, the rear surface 112 of the head 110 may also comprise additional structures (in addition to an applicator 130, as will be described below) for oral cleaning, such as a soft tissue cleaner 114. The soft tissue cleaner 114 is located on the rear surface 112 of the head 120 and is intended to clean a user's soft tissue surfaces such as the gums, tongue and cheeks. In one embodiment, the soft tissue cleaner 114 is formed of an elastomeric material. The elastomeric material of the soft tissue cleaner 114 may be any biocompatible resilient material suitable for use in an oral hygiene apparatus. To provide optimum comfort as well as cleaning benefits, the elastomeric material preferably has a hardness property in the range of A8 to A25 Shore hardness. As an example, one preferred elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 4:
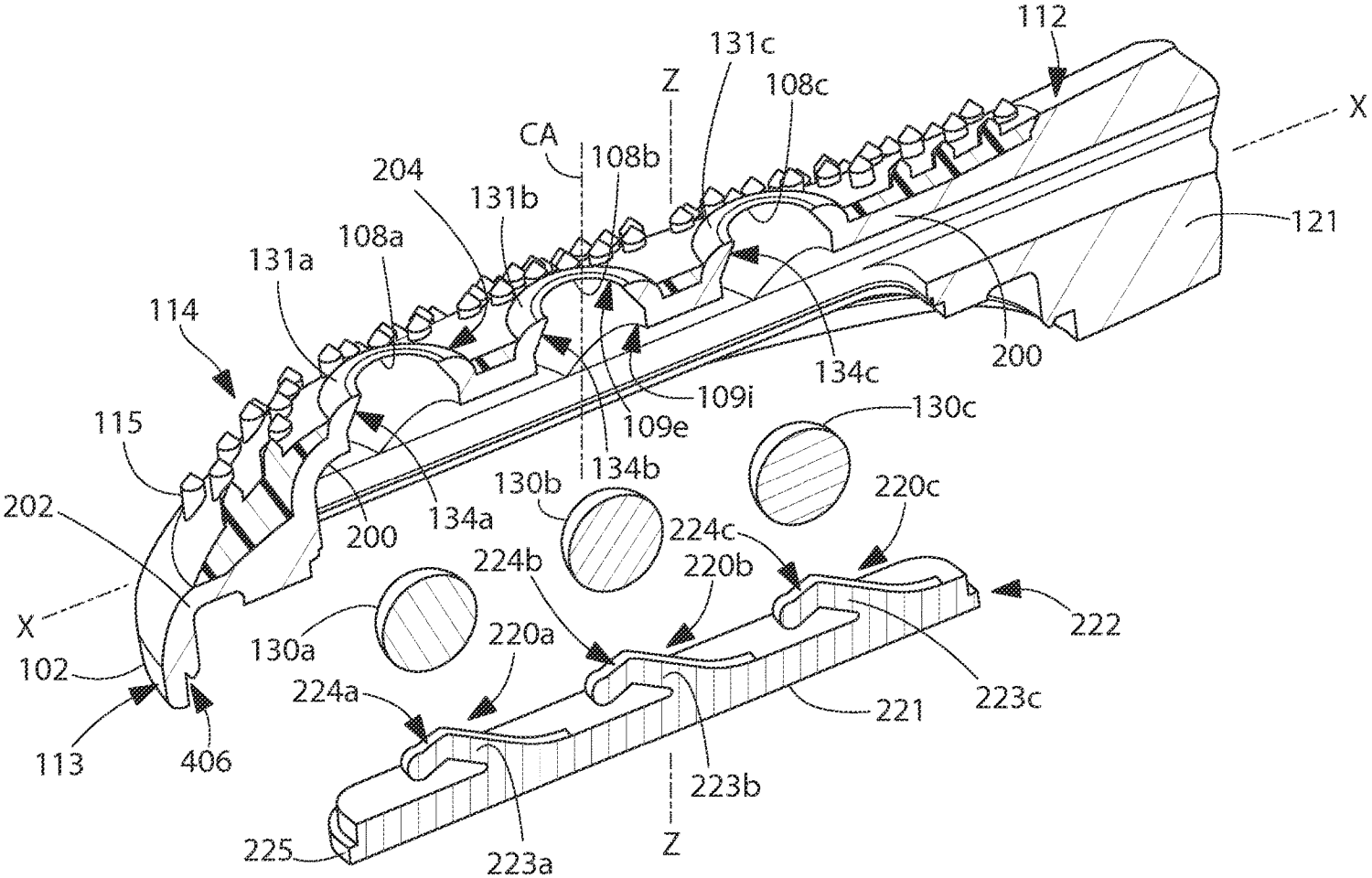
FIG. 4 is an exploded cross-sectional view of the head of the toothbrush of FIG. 1.

The soft tissue cleaner 114 comprises a plurality of protuberances, which in certain embodiments may be in the form of nubs 115 extending transversely outwards from head 110 (see FIGS. 1 and 4). As used herein a "nub" generally refers to a generally elongated column-like protrusion (referring to without limitation the cross-sectional shape of the protrusion viewed from the peripheral edges of the toothbrush head 110) which is upstanding from a base surface. In a general sense, the nub 115, in a preferred construction, has a height that is greater than the width at the base of the nub 115 (as measured in the longest direction). Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection), the base width can be substantially larger than the height.

In one preferred arrangement of the soft tissue cleaner 114, the nubs 115 are preferably conically shaped. As used herein, "conically shaped" or "conical" is meant to include true cones, frusto-conically shaped elements, and other shapes that taper to a narrow end and thereby resemble a cone irrespective of whether they are uniform, continuous in their taper, or have rounded cross-sections. An example of a suitable elastomeric soft tissue cleaner that may be used with the present invention and positioned on the rear surface 112 of the head 110 is disclosed in U.S. Pat. No. 7,143,462, issued Dec. 5, 2006 to the assignee of the present application, the entirety of which is hereby incorporated by reference. The soft tissue cleaner 114 is omitted from illustration in FIGS. 2-5 to prevent crowding in the figures and for ease of description. However, it should be understood that the soft tissue cleaner 114 can be included with any of the embodiments discussed herein.

In certain other embodiments, the protuberances of the soft tissue cleaner 114 can take the form of elongated ridges, nubs, or combinations thereof. Moreover, in certain embodiments, the soft tissue cleaner 114 can be formed out of the same material of the body 105 as discussed above. In one such embodiment, the soft tissue cleanser 114 can comprise protuberances that are integrally formed into the body 105.

The head 110 also comprises a plurality of tooth cleaning elements 116 extending outwards from the front surface 111 as shown in FIGS. 1, 2, 3A, and 3B. The plurality of tooth cleaning elements 116 conceptually forms a field of cleaning elements. The tooth cleaning elements 116 are generically illustrated as a plurality of tufts of bristles. However, the invention is in no way limited by the configuration or material of the tooth cleaning elements 116. Furthermore, while the plurality of tooth cleaning elements 116 are particularly suited for brushing and/or polishing teeth, the plurality of tooth cleaning elements 116 can also be used to clean oral soft tissue, such as a tongue, gums, or cheeks instead of or in addition to teeth. As used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of tooth cleaning elements include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus as have been described in detail above with regard to the soft tissue cleaner 114.

The plurality of tooth cleaning elements 116 can be mounted to the head 110 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Other types of tooth cleaning elements may be mounted using AFT in a similar way. Any suitable form of cleaning elements may be used in the broad practice of this invention as noted above. Alternatively, the bristles or other cleaning elements could be mounted to tuft blocks or sections by extending through suitable depressions in the tuft blocks so that the base of the bristles is mounted within or below the tuft block.

Figure 3A:
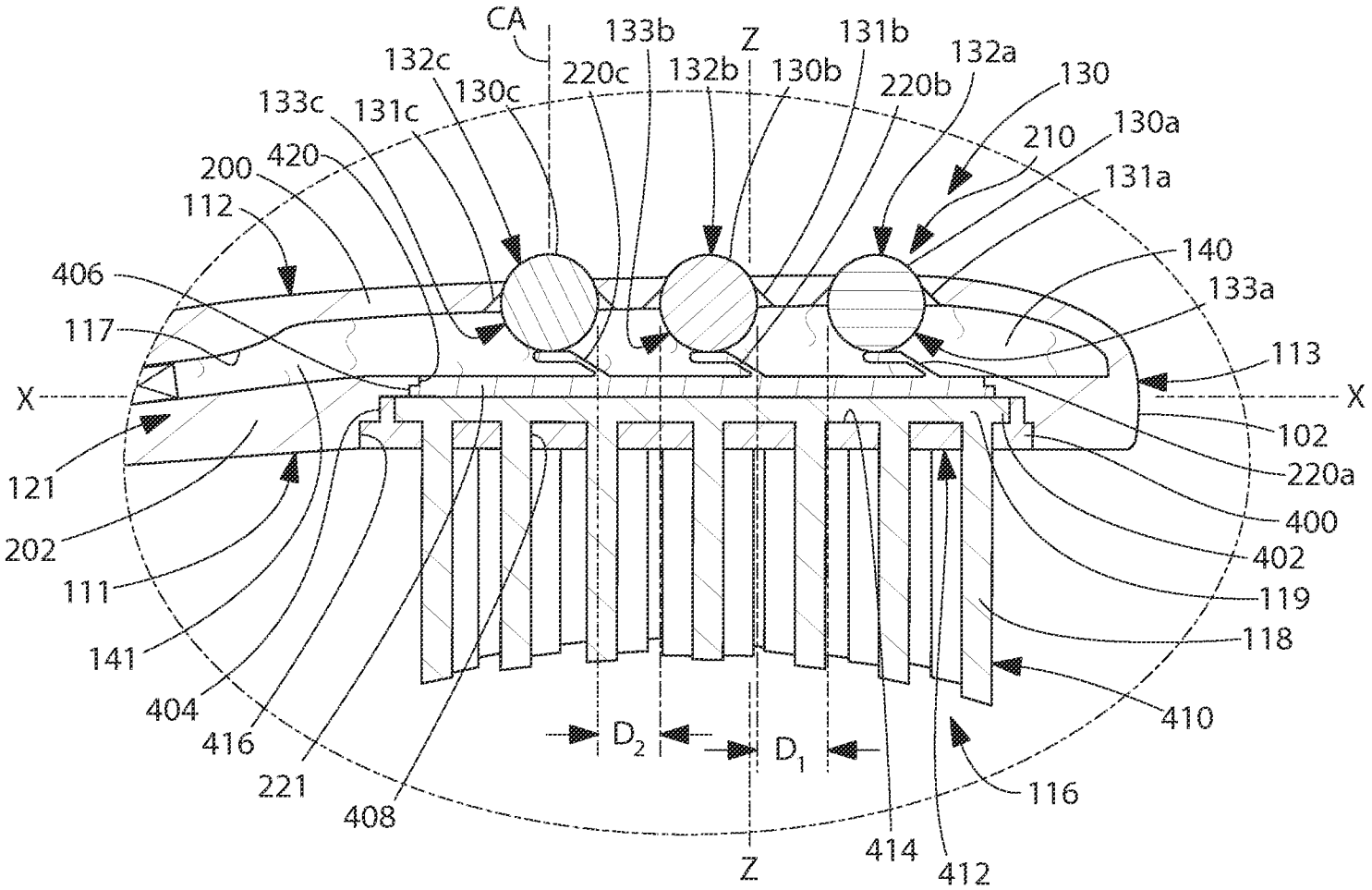
FIG. 3A is a side elevation cross-sectional view of the head of the toothbrush of FIG. 1 with a spring-actuated valve in a closed position.

In the exemplified embodiment, referring to FIG. 3A, the plurality of tooth cleaning elements 116 are coupled to the head 110 of the toothbrush body 105 using an AFT mounting method. In AFT, a head plate 400 (which can be a membrane in certain embodiments) is formed having a desired pattern of tuft holes 408. The head plate 400, in one embodiment, can be formed of any of the materials described above for the body 105. In one such embodiment, the head plate 400 is formed of one of the hard thermoplastics described herein for the body 105 using an injection molding process. Once the head plate 400 is formed, a bristle tuft 410 (or other desired tooth cleaning element, such as an elastomeric element) is inserted into each of the tuft holes 408. When so inserted, a cleaning portion 118 of each of the bristle tufts 410 protrudes freely outwards from a front surface 412 of the head plate 400 while an end anchor or base portion 119 protrudes inwards from a rear surface 414 of the head plate 400. A heating element (such as a plate) is then brought into contact with the base portions of the bristle tufts 410 that melts the base portions 119 of the bristle tufts 410, thereby flowing and fusing the base portions together to form a melt matte 402 (also known as a bristle melt in the art). Alternatively, the end portions of the bristle tufts 410 can be melted by any means known for applying heat thereto, such as convective heated gas flow and/or irradiation. When the melt matte 402 hardens, the bristles tufts 410 are secured to head plate 400 and cannot be pulled out though the front surface 412 of the head plate. As a result of the above, the completed head plate assembly 400 is formed. While the process is described above using bristle tufts 410, any type of tooth cleaning element 116 can be utilized to form the head plate assembly 400 as described above instead of or in combination with the bristle tufts.

Once the head plate assembly 400 is formed, the head plate assembly is aligned with the front basin 416 in the head 110 of toothbrush body 105. The head plate assembly 400 is then nested into the front basin 416 (as shown in FIG. 3A) and secured to the head 110. In one embodiment, as shown, the head plate 400 and the melt matte 402 are nested in the front basin 416 so that the head plate 400 contacts a shoulder or ledge 404 formed in the head 110. Once so positioned, the head plate 400 with the melt matte 402 trapped beneath the head plate in front basin 416 is secured to the head 110 using a technique such as thermal welding, sonic welding, or adhesion. Of course, other connection techniques can be utilized, such as snap-fit, tight-fit, etc.

Referring now to FIGS. 1, 2, 3A-B, and 4, the toothbrush 100 further comprises a fluidic oral care material applicator such as applicator 130 mounted to or formed integrally with the body 105 of the toothbrush. In the exemplified embodiment shown in these figures, applicator 130 may be a roll-on type applicator including one or more rotatable oral care material dispensing elements. Applicator 130 is mounted to the body 105 so as to be positioned on the rear surface 112 of the head 110 of the toothbrush 100. However, the invention is not so limited and in other embodiments (some of which will be described below), the applicator 130 can be mounted to the body 105 so as to be positioned on the front surface 111 of the head 110. In still other embodiments, the applicator 130 can be mounted to the body 105 so as to be positioned on the handle 120, such as for example at or near the proximal end 101 of the toothbrush 100. Of course, the applicator 130 can be mounted to the body 105 so as to be positioned still elsewhere on the body 105, including on the narrowed neck 121 of the toothbrush 100 (which is located between the handle 120 and the head 110). It will further be appreciated that more than one applicator 130 may be provided including any combination of the foregoing arrangements.

In the exemplified embodiment, the applicator 130 is positioned within the soft tissue cleaner 114. In other words, the applicator 130 is positioned within a field of the protuberances such as nubs 115 of the soft tissue cleaner 114 so as to utilize the protuberances to better distribute the fluidic oral care material dispensed through the applicator to the soft oral tissue of the user. In one embodiment, the applicator 130 is positioned within the field of the protuberances of the soft tissue cleaner 114 so as to be circumferentially surrounded by the protuberances. In still other embodiments, the applicator 130 is positioned within the field of the protuberances of the soft tissue cleaner 114 so that the protuberances of the soft tissue cleaner 114 are located on at least opposite sides of the applicator 130 measured along the longitudinal axis X-X or transverse axis Z-Z (see, e.g. FIG. 1).

Figure 3B:
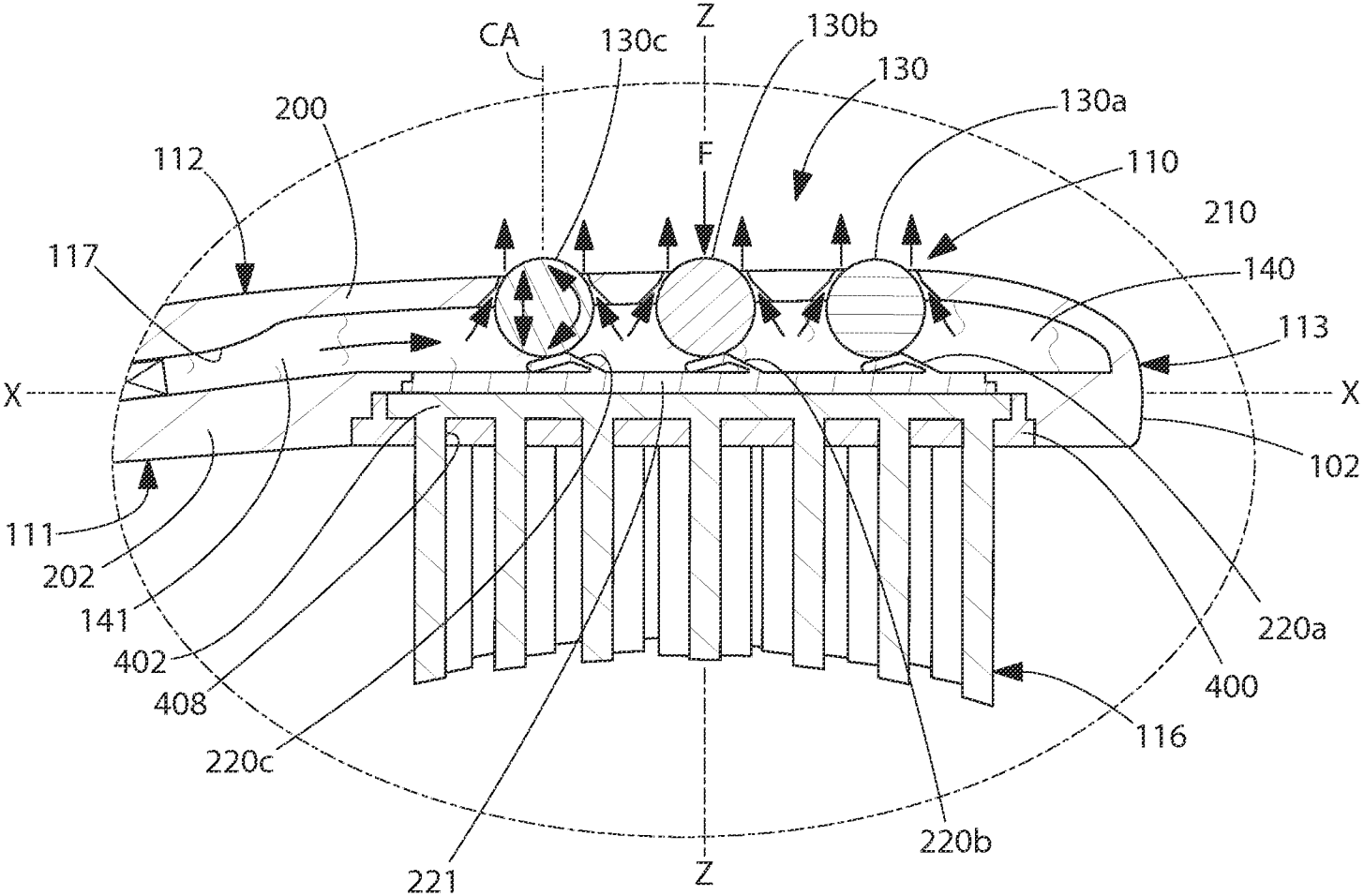
FIG. 3B is a side elevation cross-sectional view of the head of the toothbrush of FIG. 1 with the spring-actuated valve of FIG. 3A in an open dispensing position.

In the exemplified embodiment of FIGS. 1, 2, 3A-B, and 4, the applicator 130 comprises a plurality of spring-actuated valves 210 for dispensing the oral care material 141. Spring-actuated valves 210 include a depressible sealing element, a biasing or spring member 220*a-c*, and a socket 131*a-c* configured to sealingly engage a respective sealing element. As used herein, the term "spring-actuated" does not require the inclusion of a traditional spring as the biasing member. Rather, the term "spring-actuated," as used herein, includes structures in which the biasing member is any type of resilient structure or body. Spring members 220*a-c* are operable to bias the sealing elements into engagement with sockets 131*a-c*. The sealing element is linearly moveable and openable/closeable to allow flow or shutoff flow of oral care material 141 to a user. In one embodiment, where applicator 130 is a roll-on type applicator, the sealing element may be a linearly moveable and rotatable applicator ball or spherical element 130*a-c* as shown in FIGS. 3A-B and 4. Each of spherical elements 130*a-c* are linearly moveable into and out of engagement with their respective sockets 131*a-c* along the transverse Z-Z axis and also rotatable about their own rotational axis, as further described herein.

While three valves 210 and spherical elements 130*a-c* are shown in this embodiment of applicator 130, more or less than three rolling elements can be utilized as desired. In certain embodiments, the applicator 130 may comprise at least one single spherical element 130*a-c*. In the exemplified embodiment, the rolling elements are in the form of a first spherical element 130*a*, a second spherical element 130*b* and a third spherical element 130*c*. Each of the spherical elements 130*a-c* is capable of 360 degree rotation about each of the X, Y and Z axes in a Cartesian coordinate system such that there is no limit on the angle and/or degree of rotation of the spherical elements 130*a-c*.

Although the rolling elements of the applicator 130 are exemplified and described herein as spherical elements 130*a-c*, the rolling elements of the applicator 130 can take on many other three-dimensional geometries so long as the rolling elements are capable of a sufficient degree of rotation to deliver oral care material from an internal cavity and/or reservoir to the user's oral surface. Thus, the structural cooperation and concepts discussed herein can be applied to any type of rolling element that is used as the applicator 130.

The spherical elements 130*a-c* are solid in the exemplified embodiment, but can be hollow in other embodiments. The spherical elements 130*a-c* can be formed of a wide variety of materials, including rigid materials, elastomeric materials, or combinations thereof. In certain embodiments, the spherical elements 130*a-c* can be formed of hard plastics such as polypropylene or any of the other materials described above for the body 105. Other suitable materials for spherical element 130*a-c* include POM (polyoxymethylene), Glass, PC (polycarbonate), PP (polypropylene), PE (polyethylene), and PA (polyamide). Alternatively, the spherical elements 130*a-c* may be formed of a metallic material such as, for example without limitation steel, aluminum, copper or the like. In still other embodiments, the spherical elements 130*a-c* can be formed of thermoplastic elastomers having a high degree of Shore A hardness.

The outer surfaces of the spherical elements 130*a-c* are smooth in the exemplified embodiment to provide comfort to a user as well as to facilitate ease of rotation. However, in certain other embodiments, the outer surfaces of the spherical elements 130*a-c* may be roughened or may contain an irregular topography. Such embodiments may enhance the capture and delivery of an oral care material to a user's oral surfaces as will be described in detail below.

Referring to FIGS. 3A-B, each one of the spherical elements 130*a-c* is rotatably mounted to the rear surface 112 of the head 110 in a spaced-apart manner so as to be isolated from one another. In other words, each of the spherical elements 130*a-c* can function independent of the other ones of the spherical elements 130*a-c*. Thus, if one spherical element 130*a-c* were to become clogged or incapable of rotation, the other spherical elements 130*a-c* would act as a backup which continue to deliver the oral care material to the desired oral surface of the user during use.

In order to rotatably mount the spherical elements 130*a-c* to the body 105 of toothbrush 100, the rear surface 112 and wall 200 of the head 110 comprises a first socket 131*a*, a second socket 131*b* and a third socket 131*c* formed therein as best shown in FIGS. 3A, 3B, and 4. The first spherical element 130*a* is rotatably mounted in the first socket 131*a*, the second spherical element 130*b* is rotatably mounted in the second socket 131*b* and the third spherical element 130*c* is rotatably mounted in the third socket 131*c*. Each one of the sockets 131*a-c* forms a through passageway or opening 108*a*, 108*b*, and 108*c* from the external environment, through rear wall 200 of the head 110 (or body 105 if applicator 130 is located elsewhere), and into an internal cavity 140 of the head 110 which holds the fluidic oral care material. Each opening 108*a-c* defines a central hole axis CA aligned substantially parallel to transverse axis Z-Z and perpendicular to rear surface 112 of the toothbrush head 110.

When rotatably mounted within their corresponding sockets 131*a-c*, portions of each spherical elements 130*a-c* are simultaneously exposed to both the external environment and the internal cavity 140 of head 110 containing the fluidic oral care material. In the exemplified embodiment, an exterior portion of each of the spherical elements 130*a-c* protrudes outwards from the openings 108*a-c* along the Z-Z axis while another interior portion of the spherical elements 130*a-c* protrudes inwards into internal cavity 140 along the Z-Z axis.

The spherical elements 130*a-c* can be rotatably mounted within the sockets 131*a-c* in a wide variety of manners so long as the spherical elements 130*a-c* are retained within the sockets 131*a-c* and capable of the desired rotational movement. In the exemplified embodiment, referring to FIGS. 3A, 3B, and 4, the spherical elements 130*a-c* are retained within the sockets 131*a-c* due to a geometric mating between specially contoured and configured socket seating surfaces 134*a-c* of the sockets 131*a-c* and the spherical elements 130*a-c*. More specifically, each of the sockets 131*a-c* is defined by a contoured seating surface 134*a-c* configured for sealingly engaging a circumferentially extending annular portion of the spherical elements 130*a-c* to eliminate or minimize outward leakage of the fluidic oral care material from internal cavity 140 when not being intentionally dispensed. These contoured seating surfaces 134*a-c* have a concave contour that is complementary configured to generally correspond to the convex contour of the outer surfaces of the spherical elements 130*a-c*. Of course, the contours are selected so as to allow for the necessary tolerance required to allow rotation. As such, the convex contour of the outer surface of each of the spherical elements 130*a-c* nests within the concave contour of the seating surfaces 134*a-c* of the corresponding sockets 131*a-c*. In other embodiments, the spherical elements 130*a-c* can be rotatably mounted within the sockets 131*a-c* using an axle or pivot pins extending across through openings 108*a-c* to provide rotation of the spherical elements 130*a-c* within or along a single plane or axis of rotation.

Referring to FIGS. 3A, 3B, and 4, the socket seating surfaces 134*a-c* in certain embodiment are configured with a generally tapered or frusto-conical cross section having a diametrically wider internal end portion 109*i* adjacent internal cavity 140 for receiving a portion of spherical element 130*a-c* within the sockets 131*a-c* and a diametrically narrower external end portion 109*e* adjacent the rear surface 112 of head 110 (see FIG. 4). The narrow external end portions 109*e* of each socket 131*a-c* defines a portion of openings 108*a-c* having a smaller diameter than the widest or maximum diameter of the spherical elements 130*a-c* to retain the spherical element 130*a-c* in toothbrush head 110 and prevent the spherical elements from being ejected (see FIGS. 3A and 3B) under the outward biasing effect of spring members 220*a-c*, as further described herein.

Figure 7:
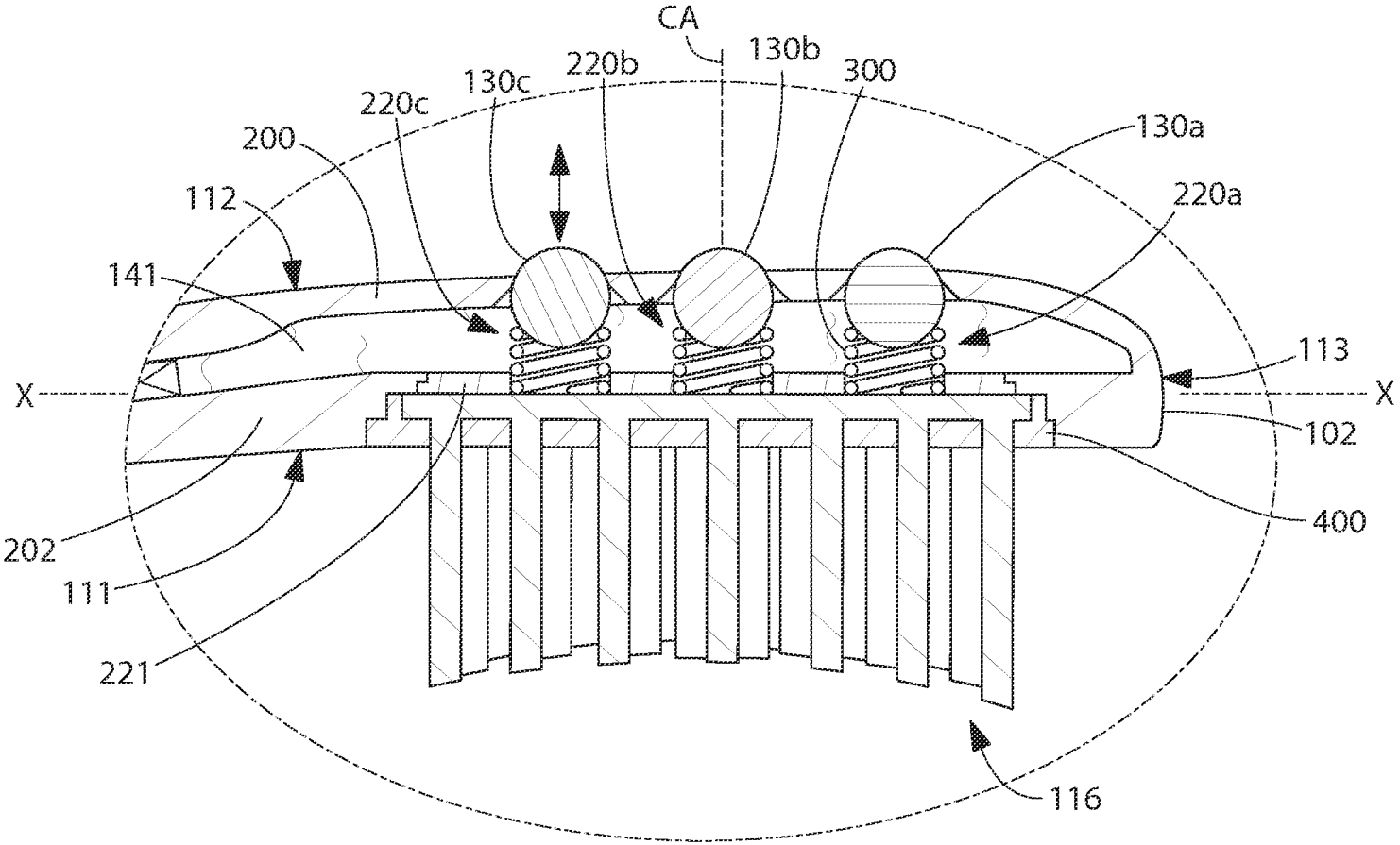
FIG. 7 is a side elevation cross-sectional view of the head of the toothbrush of FIG. 1 with a third embodiment of a spring-actuated valve in a closed position

Referring to FIGS. 2, 3A, 3B, and 4, spring members 220*a-c* are each disposed in the internal cavity 140 in toothbrush head 110 and engaged with spherical element 130*a-c*. In one embodiment, each spring member 220*a-c* may be formed as an integral unitary structural portion of a common spring plate 222. In other embodiments, each spring member 220*a-c* may be a separate spring member each engageable with spherical element 130*a-c*. In such embodiments, spring members 220*a-c* may be helical springs 300 as shown in FIG. 7 each having an end engaging spherical element 130*a-c* and an opposite end engaging an internal surface within head 110 of toothbrush 100 proximate the front surface 111 side of the toothbrush. The annular shaped surface defined by the end of each helical spring 300 that engages a spherical element 130*a-c* defines a contact surface between the springs and spherical elements.

Figure 6:
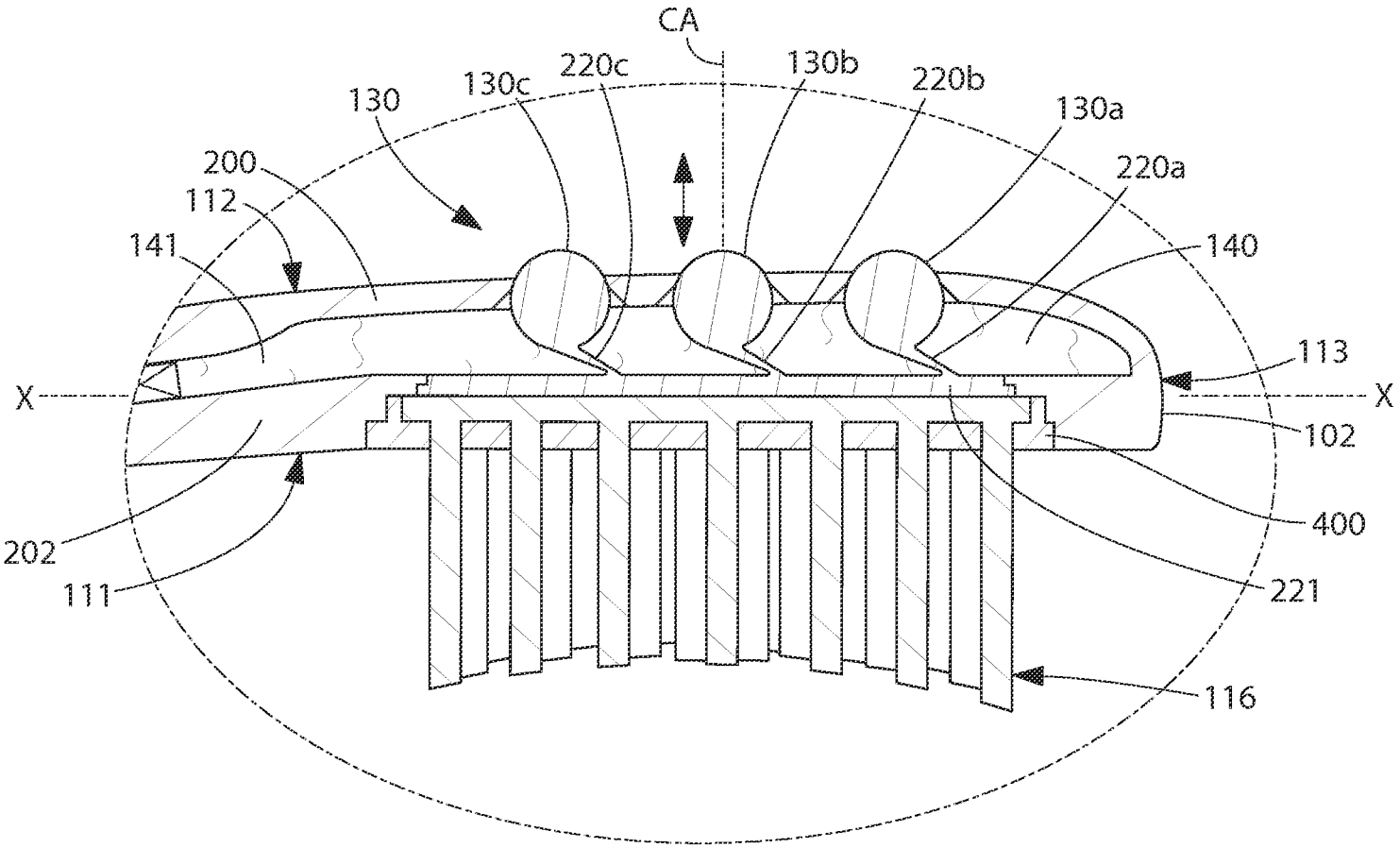
FIG. 6 is a side elevation cross-sectional view of the head of the toothbrush of FIG. 1 with a second embodiment of a spring-actuated valve in a closed position.

In another embodiment shown in FIG. 6, the spring members 220*a-c* may be formed as an integral unitary structural part of spherical elements 130*a-c*. In this embodiment, the spherical elements 130*a-c* are not rotatable within sockets 131*a-c*; rather, movement is restricted to axial movement of the spherical elements along the central hole axis CA perpendicular to the rear surface 112 of the toothbrush head 110 and in the direction of transverse axis Z-Z since the spherical elements are part of the spring members 220*a-c* having no relative motion between these two components.

Referring to FIGS. 3A, 3B, and 4, spring plate 222 includes a generally planar elongated mounting base 221 configured for mounting in toothbrush head 110. Spring members 220*a-c* are disposed on base 221. In one embodiment, spring members 220*a-c* are configured as cantilevered members extending outwards from the base 221 into internal cavity 140 in a direction towards sockets 131*a-c* in rear wall 200. Spring plate 222 provides a common base 221 for supporting spring members 220*a-c* which is mountable in toothbrush head 110. In one embodiment, spring members 220*a-c* may each be configured with a flexible elastically deformable and resilient arm 223*a-c* that defines an urging surface 224*a-c* configured to abuttingly contact and engage spherical element 130*a-c*. In one embodiment, contact surfaces 224*a-c* may be concavely shaped to complement the convex shape of the spherical element 130*a-c*. Arms 223*a-c* may be oriented at an angle with respect to the planar surface of base 221 as shown, and in some embodiments contact surfaces 224*a-c* may further be oriented at an angle in turn with respect to portions of the arms between the contact surfaces and base 221.

In one embodiment, spring plate 222 including spring members 220*a-c* may be molded from PEI (polyetherimide), PC, POM, PP and filled versions of the foregoing (e.g. glass, talc, nylon, etc.).

Referring to FIG. 3A, the toothbrush 100 is provided with an open front basin 416 that opens inwards through front wall 202 of the head 110 into the internal cavity.

Possible mounting arrangements of spring-actuated valves 210 will now be briefly described. Referring now to FIGS. 3A, 3B, and 4, the spherical elements 130*a-c* may be rotatably mounted on the rear surface 112 of the head 110 in rear wall 120 in a spaced apart manner. In the exemplified embodiment, the first spherical element 130*a* is spaced from the second spherical element 130*b* by a first distance D1 and the second spherical element 130*b* is spaced from the third spherical element 130*c* by a second distance D2 such that the first and second distances D1, D2 are the same. However, in certain other embodiments the first and second distances D1, D2 may be different in order to achieve a particular cleaning action. In the exemplified embodiment, the spherical elements 130*a-c* are aligned along the longitudinal axis X-X. Of course, the invention is not to be so limited and in certain other embodiments the spherical elements 130*a-c* can be aligned along an axis that is transverse or oblique to the longitudinal axis X-X. In still other embodiments, the spherical elements 130*a-c* could be located along an axis that is substantially parallel to but offset form the longitudinal axis X-X. In another embodiment, the spherical elements 130*a-c* may be rotatably mounted the peripheral surface 113 of the head 110. Unless specifically recited in the claims, the invention is not to be limited by the particular arrangement, number and/or positioning of the rolling elements.

The internal cavity 140 is defined by the inner surface 117 of the body 105 of the toothbrush 100. In the exemplified embodiment, the internal cavity 140 is located within the head 110 of the toothbrush 100 (see, e.g. FIGS. 2, 3A, 3B). However, in other embodiments, the internal cavity 140 can be positioned at other locations within the body 105. For example, in other embodiments, the internal cavity 140 can be located in the handle 120 and/or the neck region of the toothbrush 100. The internal cavity 140 contains and stores an oral care material 141 in close proximity to spherical elements 130*a-c* for ready dispensing to the user. Thus, the body 105 forms a housing which forms the internal cavity 140 which contains the oral care material 141.

In certain embodiments, the toothbrush 100 also comprises a delivery channel 142 that places the internal cavity 140 in fluid communication with a reservoir 150 (described below) that contains the fluidic oral care material 141, as shown in FIG. 2. However, in certain other embodiments, the internal cavity 140 is an isolated chamber and the toothbrush 100 may not include a delivery channel 142 or a separate reservoir 150. In such an embodiment, the internal cavity 140 will act as a reservoir.

The oral care material 141 is a material that provides oral health benefits to a user upon contact with a user's oral cavity. In one embodiment, the oral care material 141 is a fluidic material which is broadly defined herein as being a material capable of flowing at a temperature. The oral care material 141 may be of any viscosity so long as the material is capable of flowing through the toothbrush 100 and being dispensed through applicator 130 to a user. For example, in certain embodiments the oral care material 141 is a mouthwash solution that cleans the oral surfaces when applied thereto and provides the user with breath freshening benefits. In other embodiments, the oral care material 141 is a tooth cleaning solution. Of course, the oral care material 141 is not to be in any way limiting of the present invention and may include fluids having active or inactive agents that deliver therapeutic, cosmetic, experiential and/or sensorial benefits to a consumer during a tooth, soft tissue, tongue or interdental cleaning regimen. Specifically, the oral care material can be an anti-sensitivity agent, fluoride, a tartar protection agent, an antibacterial agent, an oxidative or whitening agent, an enamel strengthening or repair agent, a tooth erosion preventing agent, a tooth sensitivity ingredient, a gum health active, a nutritional ingredient, a tartar control or anti-stain ingredient, an enzyme, a sensate ingredient, a flavor or flavor ingredient, a breath freshening ingredient, an oral malodor reducing agent, an anti-attachment agent or sealant, a diagnostic solution, an occluding agent, a dry mouth relief ingredient, a catalyst to enhance the activity of any of these agents, colorants or aesthetic ingredients, arginine bicarbonate, chlorohexidine, triclosan, CPC, zinc oxide and combinations thereof. In certain embodiments, the oral care material 141 is free of a dentifrice as the oral care material 141 is intended to supplement traditional brushing of the teeth rather than supplant it.

FIGS. 3A, 3B, and 4 depict the exemplified embodiment in which cavity 140 is disposed in the head 110 of the toothbrush 100. The internal cavity 140 is formed between a rear wall 200 that supports applicator 130 and soft tissue cleaner 114, and an opposing front wall 202 that supports tooth cleaning elements 116. The sockets 131*a-c* are supported by and disposed in rear wall 200 and rear surface 112 defined by the rear wall. The sockets 131*a-c* may be either an integral unitary part of the rear wall 200 or a separate component mounted in the rear wall 200. Either construction may be used depending on the intended application at hand.

As discussed above, the spherical elements 130*a-c* of the applicator 130 are mounted to the rear surface 112 of the head 110 within the sockets 131*a-c* on the rear surface 112 and rear wall 200 of the head 110. The spherical elements 130*a-c* are mounted to the head 110 so that a portion of each of the spherical elements 130*a-c* protrudes inwards from corresponding sockets 131*a-c* in rear wall 200 and is in contact with the oral care material 141 contained within the internal cavity 140. Another diametrically opposed portion of each of the spherical elements 130*a-c* protrudes outwards from and beyond sockets 131*a-c* above rear wall 200 and rear surface 112 through the corresponding through opening 108*a-c* and is exposed to the external environment. Thus, as will be described in detail below, each of the spherical elements 130*a-c* comprises an exposed portion that protrudes form the outer surface 106 of the body for applying the oral care material to the user's oral surface. As the spherical elements 130*a-c* rotate within their respective sockets 131*a-c*, the oral care material 141 is delivered from the internal cavity 140 to the exposed portions of the spherical elements 130*a-c* in a rolling manner of delivery or dispensing.

In some embodiments, as shown in FIG. 4, the rear wall 200 of toothbrush head 110 may include raised annular rims 204 formed around some or all of the sockets 131*a-c* to assist with projecting the spherical elements 130*a-c* beyond the soft tissue cleaner 114 and nubs 115 for better contact with a user's soft oral tissue.

An exemplary method for assembling a toothbrush head 110 including applicator 130 and spring-actuated valves 210 will now be described. Advantageously, assembly of the applicator 130 and components of the spring-actuated valves 210 (e.g. spherical elements 130*a-c* and spring plate 222) will be incorporated into the normal AFT assembly process for toothbrush head 110 described herein so that the work process flow only requires minor modification without substantial disruption to incorporate the applicator elements. This provides efficiencies and economies in the toothbrush fabrication and head assembly process.

Referring to FIGS. 3A and 4, prior to mounting the tooth cleaning elements 116 by AFT or another method, a toothbrush 100 is first provided having a head 110 with sockets 131*a-c* already mounted or formed in rear wall 200 (see also FIG. 4). Internal cavity 141 and adjacent internal portions of rear wall 200 holding sockets 131*a-c* are exposed and accessible from the front side of the toothbrush head 110 through front basin 416 formed through front wall 202. Next, spherical elements 130*a-c* are placed in their respective sockets 131*a-c* through the front basin 416 and engaged with seating surfaces 134*a-c*.

With continuing reference to FIGS. 3A and 4, spring plate 222 is then inserted through front basin 416 and engaged with front wall 202 in a mounted position in toothbrush head 110. Front wall has an open through hole 420 extending into internal cavity 140 and a perimeter lip 406 surrounding hole 420 that is complementary configured to engage the peripheral edges 225 of spring plate 222 on base 221 (see FIG. 4). In one embodiment, perimeter lip 406 is step-shaped have a configuration for engaging a corresponding mating step-shape of peripheral edges 225 so that the spring plate 222 does not fall into internal cavity 140 due to an interference fit between the mating steps. In this manner, perimeter lip 406 defines a seat for receiving spring plate 222. Upon mounting spring plate 222 in toothbrush head 110, assembly of each spring-actuated valve 210 is completed in-situ.

Next, referring to FIG. 3A, the head plate 400 assembly with bristle matte 402 already formed in the manner already described herein is then inserted into front basin 416 and traps the spring plate 222 in head 110 of toothbrush 100, as shown. With the head plate 400 assembly and spring plate 222 nested in place in head 110, the head plate 400 is secured to the front wall 202 of toothbrush head 110 in the manner already described herein such as via thermal welding, sonic welding, adhesion, snap-fitting, etc. In one preferred embodiment, head plate 400 is thermal or sonic welded to head 110 in a way that concurrently welds spring plate 222 onto front wall 202. This hermetically seals the spring plate 222 to the front wall 202 and provides a leak-proof closure on the front side of internal cavity 140 so that the only remaining flow path for fluidic oral care material 141 to exist cavity 140 is through the spring-actuated valves 210 in the rear wall 200 of toothbrush head 110 as intended. The completed toothbrush head assembly with applicator 130 appears as shown in FIG. 3A.

Embodiments of toothbrush 105 and the oral care material dispensing applicator 130 shown in FIGS. 3A, 3B, and 4 deliver the fluidic oral care material 141 via a combination of roll-on motion of the rotating spherical elements 130*a-c* and direct dispensing of the material under pressure from pressurizer 160 via the linear movement of the valve sealing elements within toothbrush head 110, which in the present embodiment being described are spherical elements 130*a-c*.

Each of the spherical elements 130*a-c* are linearly moveable in a direction parallel to the transverse Z-Z axis and central hole axis CA of each socket 131*a-c* from an inactive closed non-dispensing position in which fluidic oral care material 141 is not dispensed (see FIG. 3A), to an active open dispensing position (see FIG. 3B) in which valve 210 is operable to dispense oral care material to the user's soft oral tissue.

An exemplary method for dispensing an oral care material 141 from a toothbrush 100 having applicator 130 will now be described. A toothbrush 100 containing the oral care material 141 is first provided. The oral care material may be filled in reservoir 500 in any suitable manner, including through fill cap or other closeable port disposed in body 105 of toothbrush 100. The spring-actuated valves 210 of applicator 130 and spherical elements 130*a-c* are in the inactive closed non-dispensing position in which fluidic oral care material 141 is not dispensed, as shown in FIG. 3A. Accordingly, the spherical elements 130*a-c* are fully engaged and abuttingly contact seating surfaces 134*a-c* of the corresponding sockets 131*a-c* to provide a seal. The resilient spring members 220*a-c* are in a fully expanded state and operably urging the spherical elements 130*a-c* against seating surfaces 134*a-c* to form the seal. Exposed external portions of the spherical elements 130*a-c* protrude outwards beyond rear surface 112 and above the base of the soft tissue cleaner 114*a* sufficient amount so that the elements 130*a-c* are positioned to engage the soft oral tissue of the user.

To apply the oral care material 141, the user then grasps the toothbrush 100 and presses applicator 130 against the soft oral tissue, such as the cheeks, gums, or tongue, either alone or in combination with brushing the teeth with tooth cleaning elements 116 on the opposite side of head 110. The externally exposed portions of spherical elements 130*a-c* engage the soft oral tissue and an inward pressing force F acting towards internal cavity 140 and longitudinal axis X-X is applied by the pressing action (see FIG. 3B). This causes the spherical elements 130*a-c* to each move linearly inwards in the direction of each corresponding central hole axis CA by a distance sufficient to at least partially unseat and disengage a portion of spherical elements 130*a-c* from seating surfaces 134*a-c* of the corresponding sockets 131*a-c*. The valves 210 and spherical elements 130*a-c* are now in the active open dispensing position. The spring members 220*a-c* are correspondingly collapsed into a compressed state, and in certain embodiments may abuttingly contact base 221 of spring plate 222 thereby acting a travel stop limiting the distance by which each spherical elements 130*a-c* may move. As shown by the flow arrows in FIG. 3B, this allows the pressurized fluidic oral care material 141 drawn from reservoir 150 to directly flow outwards through the sockets 131*a-c* between the spherical elements 130*a-c* and seating surfaces 134*a-c* where the material is dispensed and deposited onto the soft oral tissue. In addition, the dispensing and application of the oral care material 141 onto the soft oral tissue may further be assisted by the rotational or rolling action of the roll-on spherical elements 130*a-c* when the user draws the applicator 130 across the oral soft tissue thereby causing the spherical elements 130*a-c* to rotate. Accordingly, the applicator 130 shown in FIG. 3B may dispense oral care material 141 via two delivery mechanisms.

It will be appreciated that in the present embodiment being described and shown in FIGS. 3A and 3B, the applicator 130 does not rely solely on the rotational or roll-on oral care material delivery mechanism. Therefore, advantageously, even if in certain instances there is insufficient friction produced by the user's soft oral tissue to cause rotation of the spherical elements 130*a-c* (e.g. excessive saliva or dentifrice on the tissue surfaces), the oral care material 141 will nonetheless still be dispensed via a direct outflow from the partially open sockets 131*a-c* of the spring-actuated valves 210 as described above.

When the user disengages the oral care material applicator 130 from the soft oral tissue, the inward pressing force F will be relieved. Spring members 220*a-c* will now again act to urge and move spherical elements 130*a-c* linearly outwards from internal cavity 140 to engage seating surfaces 134*a-c* of the corresponding sockets 131*a-c*, as shown in FIG. 3A. The spring-actuated valves 210 of applicator 130 and spherical elements 130*a-c* are returned to the inactive closed non-dispensing position in which fluidic oral care material 141 is not dispensed.

It should be understood that the applicator embodiment of FIG. 6 in which the spherical elements 130*a-c* are formed integral with spring members 220*a-c*, there would be only a linear axial movement component for the spherical elements without rotation. Accordingly, this embodiment delivers oral care material 141 via direct outflow from spring-actuated valves 210.

In the applicator embodiment of FIG. 7, the spherical elements 130*a-c* are not constrained by the spring members 220*a-c* from rotating. Accordingly, this embodiment delivers oral care material via both direct outflow and rotational delivery mechanism similar to the embodiment of FIGS. 3A and 3B.

The functional details of the spherical elements 130*a-c* will now be further described with respect to the first spherical element 130*a* with the understanding that the below-discussion is equally applicable to the other two spherical elements 130*b-c* and any other structural embodiments which the rolling element may take.

The first spherical element 130*a* comprises an exposed portion 132*a* and an internal portion 133*a*. The exposed portion 132*a* protrudes from the rear surface 106 of the body 105 (which in the exemplified embodiment is the rear surface 112 of the head 110) while the internal portion 133*a* is positioned within the internal cavity 140 and in contact with and wetted by the oral care material 141 therein. It should be understood that the exposed portion 132*a* and the internal portion 133*a* of the first spherical element 130*a* are not a particular segment/area of the first spherical element 130*a* itself, but are rather defined by the relative rotational positioning of a portion of spherical element 130*a* with respect to the head 110 and/or external environment. Thus, the segments/areas of the first spherical element 130*a* that comprise the exposed and internal portions 132*a*, 133*a* change during rotation of the first spherical element 130*a* upon application of the fluidic oral care material 141 to the user. Moreover, during rotation of the spherical element 130*a*, the particular segment/area of the first spherical element 130*a* that forms the exposed portion 132*a* of the first spherical element 130*a* at a certain time may also form the internal portion 133*a* of the first spherical element 130*a* at a different time.

In operation, as the spherical element 130*a* is rotated within socket 131*a* due to frictional contact with the oral tissue surface, the oral care material 141 within the internal cavity 140 adheres to the segment/area of the spherical element 130*a* that is, at that time, the internal portion 133*a*. As the spherical element 130*a* continues to rotate, the segment/area of the spherical element 130*a* having the oral care material 141 adhered thereto becomes the exposed portion 132*a* of the spherical element 130*a* (at a subsequent time), thereby allowing the adhered oral care material 141 to be applied to the desired oral tissue surface.

In a similar manner described above, the second spherical element 130*b* also comprises an exposed portion 132*b* and an internal portion 133*b* while the third spherical element 130*c* comprises an exposed portion 132*c* and an internal portion 133*c*, as shown in FIGS. 3A and 3B.

As set forth above, the applicator 130 delivers the oral care material 141 from the internal cavity 140 to the exposed portions 132*a-c* of the spherical elements 130*a-c* due to rotation of the spherical elements 130*a-c* during use of the toothbrush 100. The adherence of the oral care material 141 to the spherical elements 130*a-c* can be the result of the tackiness of the oral care material 141, a capillary action, and/or surface tension between the oral care material 141 and the spherical elements 130*a-c*. When a user desires to dispense the oral care material 141 from the internal cavity 140 to an oral tissue surface, the exposed portions 132*a-c* of the spherical elements 130*a-c* are first put into contact with the desired oral surface. The toothbrush 100 is then translated. Due to the frictional engagement between the exposed portions 132*a-c* of the spherical elements 130*a-c* and the oral surface, the spherical elements 130*a-c* rotate during said translation, thereby dispensing the oral care material 141 onto the oral surface. This dispensing can occur indirectly during brushing of the teeth or be specifically intended, such as brushing of the tongue with the rear surface 112 of the head 110. The spherical elements 130*a-c* will continue to rotate throughout use of the toothbrush 100 so that fresh oral care material 141 will continually be delivered from the internal cavity 140 to the exposed portions 132*a-c* of the spherical elements 130*a-c* for application to the user's oral cavity. As discussed in above, each of the spherical elements 130*a-c* is capable of 360 degree rotation about each of the X-axis, Y-axis and Z-axis of the Cartesian coordinate system, wherein the center of the subject spherical elements 130*a-c* is considered the 0-0-0 point. However, such unlimited degrees of rotational freedom are not necessary in all embodiments of the invention. In certain embodiments, the rolling element(s) of the applicator 130 will have at least 360 degrees of rotational freedom about at least a single axis. In one such embodiment, this single axis may be substantially perpendicular to the longitudinal axis X-X of the toothbrush 100.

The fluidic oral care material 141 storage and dispensing system components will now be described in greater detail. Referring to FIGS. 2 and 3A, the body 105 of toothbrush 100 further includes a reservoir 150 that contains an additional amount/volume of the oral care material 141 besides the oral care material temporarily held in toothbrush head 110 within the internal cavity 141 as described herein. The reservoir 150 is in fluid communication with the internal cavity 140 via a flow conduit such as delivery channel 142. However, in certain other embodiments, the internal cavity 140 may be the only chamber within the body 105 of toothbrush 100 that contains the oral care material 141, and thus, can conceptually be considered a reservoir in such embodiments. In one embodiment, the reservoir 150 has a larger volumetric capacity for oral care material 141 than the internal cavity 140.

The delivery channel 142 extends from the reservoir 150 to the internal cavity 140 through neck 121, thereby forming a fluid passageway from the reservoir 150 to the internal cavity 140 that facilitates the fluid communication between the reservoir 150 and the internal cavity 140. In the exemplified embodiment, the delivery channel 142 extends axially along the longitudinal axis X-X. In other embodiments, the delivery channel 142 may extend substantially transverse or at an oblique angle to the longitudinal axis X-X. The delivery channel 142 may be linear, curved, and/or combinations thereof. The exact shape (i.e. longitudinal and transverse cross-sectional) and orientation of the delivery channel 142 will be dictated by considerations such as the position of the internal cavity 140, the position of the reservoir 150, and the shape of the body 105 of the toothbrush 100. While the internal cavity 140 is shown as being a larger chamber than the delivery channel 142 in cross-section, in certain alternate embodiments the internal cavity 140 can be considered merely a portion or extension of the delivery channel 142.

Referring to FIG. 2, the toothbrush 100 further comprises a pressurizer 160 for dispensing and maintaining the oral care material 141 in contact with the spherical elements 130*a-c* of the applicator 130. In the exemplified embodiment, the pressurizer 160 is operably coupled to the reservoir 150 to pressurize the oral care material 141 contents in the reservoir. However, in other embodiments, the pressurizer 160 can be operably coupled directly to the internal cavity 140 or to the delivery channel 142.

The pressurizer 160 can be any type of pressurizer known in the art, such as for example without limitation a movable piston or a user-operable pump. Examples of user-operated pumps include a compressible bladder, an electrical pump, a manual pump, a gas-generating cell. The pressurizer 160 is operated by the user to increase the pressure within the reservoir 150, which in turn forces the oral care material 141 to flow from the reservoir 150 to the internal cavity 140, thereby continually supplying and filling the internal cavity 140 with the oral care material 141. Thus, by pressurizing the oral care material 141 within the reservoir 150, the pressurizer 160 also indirectly pressurizes the internal cavity 140 due to the fluid communication between the reservoir 150 and the internal cavity 140.

The pressurizer 160 ensures that the internal cavity 140 remains filled with the oral care material 141 so that the internal portions 133*a-c* of the spherical elements 130*a-c* of the applicator 130 are maintained in contact with the oral care material 141 at all times. If the internal cavity 140 becomes empty and devoid of the oral care material 141, the applicator 130 will either not be operable to dispense the oral care material 141 to the user's oral surfaces or a delay would result in the dispensing time, neither of which is particularly desirable. Thus, the pressurizer 160 ensures that the internal cavity 140 remains filled with the oral care material 141 so that the applicator 130 remains in contact with the oral care material 141 and ready essentially immediately for dispensing when desired by the user.

In certain embodiments of the present invention, however, the pressurizer 160 may be omitted and other mechanisms and/or methods for delivering the oral care material 141 to the applicator 130 may be utilized. In one embodiment, delivery can be accomplished by using a passive delivery system, such as a capillary action delivery mechanism. In one such embodiment, a capillary material, such as a porous material, a fibrous material, or an open cell material, can extend from the reservoir 150 to the internal cavity 140 and delivery the oral care material 141 to the applicator 130 solely by capillary action. In this embodiment, the capillary material may fill (or at least partially fill) the internal cavity 140 so as to contact and/or be sufficiently adjacent the applicator 130 such that the oral care material 141 is transferred thereto. In another embodiment, the oral care material 141 may be delivered from the reservoir 150 to the internal cavity 140 (and into contact with the applicator 130) simply by the mechanical action of brushing.

In the exemplified embodiment, the toothbrush 100 further comprises a one-way valve 161 that is positioned in the delivery channel 142. Of course, the invention is not to be so limited and the one-way valve 161 can be positioned at other locations along the fluid path within the body 105. In one embodiment, it is simply preferred that the one-way valve be operably coupled between the reservoir 150 and the internal cavity 140. Thus, the one-way valve 161 can be positioned at an exit point of the reservoir 150 or at an entrance point of the internal cavity 140 or at any location therebetween. The one-way valve 160 permits the oral care material 141 to flow from the reservoir 150 to the internal cavity 140 while preventing or prohibiting the oral care material 141 from flowing from the internal cavity 140 into the reservoir 150. Thus, the one-way valve 161 also ensures that the internal cavity 140 remains filled so that the applicator 130 can maintain contact with the oral care material 141 within the internal cavity 140.

When the amount of the oral care material 141 within the internal cavity 140 becomes low or depleted, the oral care material 150 within the reservoir 150 can be forced into the internal cavity 140 via automated or user-operated activation the pressurizer 160. The oral care material 141 is maintained within the internal cavity 140 due to the existence of the one-way valve 161 thereby preventing flow back to the reservoir. Thus, the reservoir 150 contains an additional supply of the oral care material 141 to enable the toothbrush 100 to continue operating as desired even after an initial supply of the oral care material 141 within the internal cavity 140 has been depleted.

While the foregoing description discusses a single internal cavity 140, a single delivery channel 142, and a single reservoir 150, in certain embodiments, multiple internal cavities, multiple delivery channels, and multiple reservoirs may b provided such that different oral care materials may be provided and dispensed to the user via the spherical elements 130*a-c*.

Figure 5A:
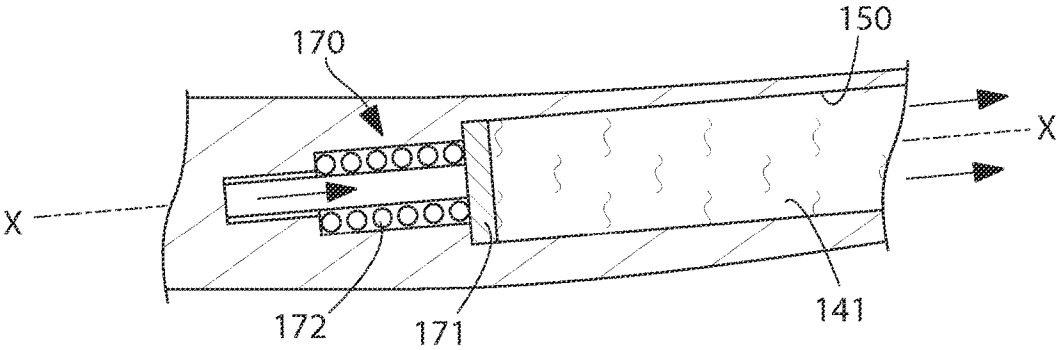
FIG. 5A is a schematic of one embodiment of a pressurizer in the form of a movable piston that can be used in the toothbrush of FIG. 1 according to one embodiment of the present invention.

Turning now to FIG. 5A, one particular example of a pressurizer 170 will be described. The pressurizer 170 comprises a movable piston 171 that forces the oral care material 141 from the reservoir 150 to the internal cavity 140. In the exemplified embodiment, the pressurizer 170 includes a biasing member 172 that automatically provides a constant pressure on the reservoir 150 and reduces the volume of the reservoir 150 as the oral care material 141 is dispensed. In the exemplified embodiment, the biasing member 172 is a coil spring. In other embodiments, the biasing member 172 can be any type of resilient component, including without limitation different types of springs, elastomeric elements, resilient prongs and/or combinations thereof. As the oral care material 141 within the internal cavity 140 becomes depleted, the biasing member 172 will extend in an axial direction along longitudinal axis X-X. As the biasing member 172 extends in the axial direction, the piston 171 also moves in the same axial direction and thereby decreases the interior volume of the reservoir 150. Thus, the piston 171, which is in constant contact with the oral care material 141, pressurizes and forces the oral care material 141 to migrate in the axial direction towards the internal cavity 140 via dispensing channel 142. The biasing member 172 and piston 171 only move in the axial direction as the oral care material 141 is removed from the internal cavity 140 as a result of usage of the toothbrush 100. The biasing member 172 preferably should have sufficient force to pressurize the oral care material 141 sufficiently to overcome frictional flow resistance through the applicator 130 when dispensing the oral care material. It should be understood that in embodiments that have the pressurizer 170, the one-way valve 161 may be omitted because the volume of the reservoir 150 decreases as the piston 171 moves in the axial direction. Decreasing the volume of the reservoir 150 prevents the oral care material 141 from flowing from the internal cavity 140 back to the reservoir 150 because of the corresponding decrease in volume of the reservoir 150.

In other embodiments using a movable piston 171 as part of the pressurizer 170, the movable piston 171 can be translated either manually or electronically due to user actuation. For example, a ratchet or drive screw assembly could be used.

Figure 5B:
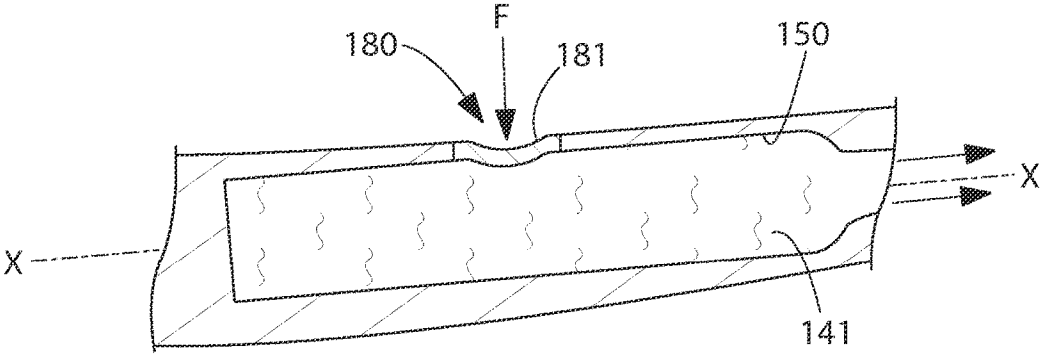
FIG. 5B is a schematic of another embodiment of a pressurizer in the form of a compressible wall that can be used in the toothbrush of FIG. 1 according to another embodiment of the present invention.

Referring now to FIG. 5B, an exemplary pressurizer 180 will be described. The pressurizer 180 is illustrated as a user-operable manual pump. Specifically, the pressurizer 180 is formed by a compressible portion 181 of the body 105 that is formed of a compressible material. The compressible material may be a resilient material, such as an elastomeric material, a flexible plastic material or the like in preferred embodiments. As the oral care material 141 within the internal cavity 140 of head 110 becomes depleted, a user can press down on the compressible portion 181 of the body 105 with a transverse force F in the direction of the arrow, thereby forcing the oral care material 141 within the reservoir 150 to flow towards and into the internal cavity 140. Pressing down on the compressible portion 181 with the force F in the direction of the arrow temporarily increases the pressure in the reservoir 150. The compressible portion 181 preferably biases back to its normal structural configuration after the user stops applying the force F to the compressible portion 18 through the use of a proper pressure relief valve. It should be understood that any of the embodiments described herein may also include the one-way valve 161 to prevent the oral care material 141 from flowing back from the internal cavity 140 into the reservoir 150.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments. For example, in certain embodiments, the delivery of the oral care fluid from the reservoir to the applicator can be supplemented by mechanical action if desired.

What is claimed is:

1. A toothbrush comprising:

a body comprising a handle, a head coupled to the handle, and an internal cavity containing an oral care material;

a plurality of tooth cleaning elements extending from a front surface of the head; and an applicator disposed on a rear surface of the head opposite the front surface, the applicator in fluid communication with the internal cavity;

the applicator comprising at least one spring-actuated valve movable from a closed non-dispensing position to an open dispensing position upon applying a pressing force against an externally exposed portion of the valve wherein oral care material is dispensed from the internal cavity.

2. The toothbrush according to claim 1, wherein the at least one spring-actuated valve includes a linearly moveable sealing element and a spring member biasing the sealing element into the closed non-dispensing position.

3. The toothbrush according to claim 2, wherein the toothbrush further defines a longitudinal axis, the sealing element being linearly moveable in a direction transverse to the longitudinal axis.

4. The toothbrush according to claim 3, wherein the sealing element is both rotatable and linearly moveable.

5. The toothbrush according to claim 2, wherein the sealing element has an externally exposed portion accessible from an outer surface of the toothbrush and an internal portion in contact with the oral care material contained in the internal cavity.

6. The toothbrush according to claim 2, wherein the sealing element is a spherical element mounted in the at least one spring-actuated valve.

7. The toothbrush according to claim 2, wherein the sealing element is mounted in a socket disposed in the head of the toothbrush and the socket defines a seating surface configured for engaging the sealing element.

8. The toothbrush according to claim 1, wherein the applicator includes at least a second spring actuated valve.

9. The toothbrush according to claim 1, wherein the internal cavity is located within the head.

10. The toothbrush according to claim 1, further comprising a pressurizer that pressurizes the oral care material within the internal cavity for dispensing through the applicator.

11. The toothbrush according to claim 1, further comprising a reservoir in the body containing the oral care material, the reservoir being in fluid communication with the internal cavity.

12. A toothbrush comprising:

a body comprising a handle, a head coupled to the handle, and an internal cavity containing an oral care material;

a plurality of tooth cleaning elements extending from the head;

an applicator disposed in the head and in fluid communication with the internal cavity; and a soft tissue cleaner comprising one or more protuberances, the applicator positioned within the soft tissue cleaner;

the applicator comprising at least one spring-actuated valve movable from a closed non-dispensing position to an open dispensing position upon applying a pressing force against an externally exposed portion of the valve wherein oral care material is dispensed from the internal cavity.

13. A toothbrush comprising:

a body defining a longitudinal axis and comprising a handle, a head coupled to the handle, and a pressurized internal cavity containing an oral care material;

a plurality of tooth cleaning elements extending from the head;

an applicator disposed in the head and in fluid communication with the pressurized internal cavity;

the applicator comprising a plurality of spring-actuated valves, each of the spring-actuated valves movable from a closed non-dispensing position to an open dispensing position upon applying a pressing force against an externally exposed portion of the spring-actuated valves, the spring-actuated valves dispensing the oral care material as a result of the pressing force applied directly to the spring-actuated valves; and wherein each of the spring-actuated valves includes a depressible sealing element and a spring member biasing the sealing element into the closed non-dispensing position, the sealing element being linearly movable.

14. The toothbrush according to claim 13, wherein the sealing elements comprise the externally exposed portions of the spring-actuated valves, the externally exposed portions being accessible from an outer surface of the toothbrush, and the sealing elements further comprising an internal portion in contact with the oral care material contained in the internal cavity.

15. The toothbrush according to claim 13, wherein each of the sealing elements is mounted in a socket disposed in the head of the toothbrush, each of the sockets defining a seating surface configured for engaging one of the sealing elements.

16. The toothbrush according to claim 13, wherein each of the sealing elements is integrally formed with a respective one of the spring members such that there is no relative movement between the sealing elements and the respective one of the spring members.

17. The toothbrush according to claim 13, wherein each spring member is disposed on a common base mounted in the head of the toothbrush.

18. The toothbrush according to claim 13, wherein the applicator comprises a spring plate mounted in the head of the toothbrush, the spring members being disposed on the spring plate, a plurality of sockets disposed in the head of the toothbrush, and the depressible sealing elements engageable with the plurality of sockets, each one of the spring members, sockets, and sealing elements collectively defining the spring-actuated valve, each of the sealing elements being linearly movable from the closed non-dispensing position to the open dispensing position upon applying the pressing force against the sealing element.

19. The toothbrush according to claim 18, wherein each of the sealing elements are spherical elements linearly moveable into and out of engagement with a respective one of the sockets in a direction transverse to the longitudinal axis of the toothbrush.

20. The toothbrush according to claim 18, wherein the spring members are configured as cantilevered arms disposed on the spring plate.

* * * * *